US008166986B2

(12) United States Patent
Ma

(10) Patent No.: US 8,166,986 B2
(45) Date of Patent: May 1, 2012

(54) QUICK CONNECTOR HUB FOR SHADE STRUCTURE

(75) Inventor: Oliver Joen-an Ma, Arcadia, CA (US)

(73) Assignee: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 13/031,100

(22) Filed: Feb. 18, 2011

(65) Prior Publication Data

US 2011/0209732 A1 Sep. 1, 2011

Related U.S. Application Data

(63) Continuation of application No. 12/105,237, filed on Apr. 17, 2008, now Pat. No. 7,891,367.

(51) Int. Cl.
*A45B 25/06* (2006.01)

(52) U.S. Cl. ..... 135/19.5; 135/28; 135/29; 135/30

(58) Field of Classification Search ..... 135/28, 135/29, 30, 19.5
See application file for complete search history.

(56) References Cited

U.S. PATENT DOCUMENTS

| | | | |
|---|---|---|---|
| 501,089 | A | 7/1893 | Lichtenstein |
| 770,704 | A | 9/1904 | Vogel |
| 897,026 | A | 8/1908 | Seitzinger |
| 941,952 | A | 11/1909 | Riehl |
| 947,790 | A | 2/1910 | Carter |
| 1,469,495 | A | 10/1923 | Bunker |
| 2,321,495 | A | 6/1943 | Levin |
| 2,336,116 | A | 12/1943 | Morando |
| 2,385,575 | A | 9/1945 | Isler |
| 2,469,637 | A | 5/1949 | Evans et al. |
| 2,635,616 | A | 4/1953 | Haydu |
| 2,762,383 | A | 9/1956 | Wittman |
| 2,796,073 | A | 6/1957 | Wittman |
| 2,860,647 | A | 11/1958 | Negri |
| 3,177,882 | A | 4/1965 | Militano |
| 3,462,179 | A | 8/1969 | Hinkle |
| 3,643,673 | A | 2/1972 | Weber |
| 3,704,479 | A | 12/1972 | Whitaker |
| 4,201,237 | A | 5/1980 | Watts et al. |
| 4,368,749 | A | 1/1983 | Lindler et al. |
| 4,750,509 | A | 6/1988 | Kim |
| 5,085,239 | A | 2/1992 | Chin-Hung et al. |
| 5,193,566 | A | 3/1993 | Chen |
| 5,328,286 | A | 7/1994 | Lee |
| 5,740,824 | A | 4/1998 | Tang |
| 6,311,706 | B1 | 11/2001 | Sato |
| 6,314,976 | B1 | 11/2001 | Clarke |
| 6,386,215 | B1 | 5/2002 | Chang |
| 6,397,867 | B2 | 6/2002 | You |
| 6,643,889 | B1 | 11/2003 | Kotlarski |

(Continued)

FOREIGN PATENT DOCUMENTS

GB 2113543 8/1983

*Primary Examiner* — Noah Chandler Hawk
(74) *Attorney, Agent, or Firm* — Knobbe Martens Olson & Bear, LLP

(57) ABSTRACT

An umbrella hub is provided which can comprise a central portion, a body, and an engagement section. The central portion can be configured to receive to an umbrella pole. The body can extend between the central portion and an outer periphery of the hub with the engagement section being located adjacent to the outer periphery thereof. The engagement section can be configured to receive and constrained the movement of an end portion of an umbrella structural member.

28 Claims, 15 Drawing Sheets

U.S. PATENT DOCUMENTS

| | | | |
|---|---|---|---|
| 6,701,946 | B2 | 3/2004 | You |
| 6,705,335 | B2 | 3/2004 | You |
| 6,814,093 | B2 | 11/2004 | You |
| 7,178,535 | B2 | 2/2007 | Eder |
| 7,703,464 | B2 | 4/2010 | Ma |
| 7,891,367 | B2 | 2/2011 | Ma |
| 2004/0123891 | A1 | 7/2004 | Ma |
| 2005/0115599 | A1 | 6/2005 | You |
| 2007/0172310 | A1 | 7/2007 | Yang et al. |
| 2010/0224225 | A1 | 9/2010 | Ma |

QUICK CONNECTOR HUB FOR SHADE STRUCTURE

CROSS-REFERENCE TO RELATED APPLICATIONS

This application is a continuation of U.S. application Ser. No. 12/105,237, filed Apr. 17, 2008, the entirety of which is hereby incorporated herein by reference.

BACKGROUND

1. Field of the Inventions

The present inventions relate generally to interconnecting joints of shade structures (e.g. umbrellas and portable pavilions) having frames, and more specifically, to a uniquely configured umbrella hub that can enable quick and secure coupling of one member of the umbrella to the hub during the set up of such structures.

2. Description of the Related Art

Larger umbrellas, such as market umbrellas, generally include a frame-like structure that is used to support and distribute the weight of an upper portion of the umbrella as well as to enable the umbrella to be opened and closed as desired by the user. The frame-like structure of such umbrellas can take various forms, but often includes one more hubs connected with a plurality of movable structural members.

The interconnection between hubs and structural members, such as umbrella ribs, previously had been achieved in an inconvenient way that was not adapted for rapid or low-cost assembly. In general, such prior interconnections were achieved in manufacturing by assembling a hub with a large number of pins and fasteners and coupling the ribs one by one to the hub with these pins and fasteners prior to full assembly of the hub. This process was extremely labor-intensive, costly, and could not be achieved quickly to provide suitable assembly times. This process also involved a large number of subcomponents, which could be difficult to manage in a supply chain, as well as in the assembly process itself.

SUMMARY

An aspect of at least one of the embodiments disclosed herein is the realization that the connection devices used in the assembly of shade structures, such as pavilions and outdoor umbrellas, can be improved to provide a more secure, quicker, and more reliable connection. Such devices can use fewer parts and be easier to manufacture than those devices of the prior art. Such improved connections can be particularly advantageous for large shade structures which can sometimes be unwieldy.

According to another aspect of at least one embodiment disclosed herein is the realization that prior art umbrella hubs include an excessive amount of individual components. For example, individual pins are often individually placed into a portion of the hub before portions of the hub are carefully assembled. This tedious manufacturing can be costly and frustrating. Therefore, embodiments disclosed herein seek to remedy this deficiency by providing a hub assembly that uses a reduced number of parts. Accordingly, the time and cost required for manufacturing the hub can be greatly decreased.

Another aspect of at least one of the embodiments disclosed herein is the realization that while some devices to expedite assembly have been suggested, such devices have been inadequate, for example lacking the ability to bear a full range of operational loads, which can be much higher than the weight of the components of the shade structure, particularly in windy conditions. As such, the members of a frame of a shade structure should be quickly, securely, and firmly interconnected so that the frame can properly support not only the weight of the various structural members and the canopy, but also the stresses and other forces that are common or possible during the use of such structures.

In accordance with an embodiment, an umbrella hub is provided which can comprise a central portion, a body, and a retention mechanism. The central portion can be configured to receive to an umbrella pole. The body extends between the central portion and an outer periphery of the hub and can comprise an engagement section adjacent to the outer periphery. The engagement section can be configured to receive an end portion of an umbrella structural member. The retention mechanism can be disposed within the engagement section and can comprise an elongate channel having a first portion and a second portion. The first portion can be located between the second portion and the outer periphery of the body. The first portion can have a first width and the second portion can have a second width. The first and second widths can be measured in a generally vertical plane. In this regard, the first width can be generally less than a second width.

In some embodiments, the retention mechanism can further comprise a capture member, which can be deflectable, disposed within the channel. The hub can further comprise an upper hub section defining a portion of the engagement section and a lower hub section defining another portion of the engagement section. In this regard, the capture member can be disposed between the upper and lower hub sections. The hub can further comprise a locking component disposed intermediate an upper hub section and a lower hub section, and be configured such that the capture member extends from the locking component into the engagement section for securing the structural rib or connector of the umbrella to the hub.

The capture member can comprise a ramped surface disposed in the elongated channel. The ramped surface can be configured to engage a structural member directed through the first portion of the elongate channel toward the second portion thereof and to respond to said engagement by moving from a first position in which the ramped surface protrudes a first amount into the engagement section to a second position in which the ramped surface protrudes a lesser amount into the engagement section.

The hub can further comprise a plurality of engagement sections disposed about the body adjacent to the outer periphery. In such an embodiment, the hub can further comprise a plurality of capture members extending from the locking component. The capture members can extend inwardly from a side surface of the engagement section and can be deflectable upon engagement with a structural member of an umbrella. Further, the hub can be configured such that the plurality of capture members can extend into each engagement section from opposing side surfaces of the engagement section.

In accordance with another embodiment, an umbrella hub is provided which can comprise a hub, an engagement section, and a locking component. The hub can comprise upper and lower hub sections. The upper hub section can be configured to receive an umbrella pole. The upper hub section can define a lower region and a plurality of first slots. The first slots can be disposed about an outer periphery of the upper hub section. The lower hub section can be configured to receive the umbrella pole. The lower hub section can define an upper region and a plurality of second slots. The second slots can be disposed generally about an outer periphery of the lower hub section. The lower hub section can be configured with the upper region thereof being connectable to the lower region of the upper hub section.

The engagement section can be formed by the pluralities of first and second slots of the upper and lower hub sections, respectively. Each engagement section can be configured to receive an end portion of an umbrella structural member. The locking component can be disposed intermediate the upper and lower hub sections when the upper hub section is connected with the lower hub section. The locking component can comprise a component body and a capture member extending from the component body into the engagement section of the hub body for securing the structural rib or connector of the umbrella to the hub.

The hub can be configured such that the locking component comprises pairs of capture members extending into each of the engagement sections. Further, the component body of the locking component can be fixed relative to the engagement sections of the hub body. In addition, the capture member can be configured to deflect in a horizontal direction.

The locking component can comprise a plurality of Y-shaped resilient latch portions. Each Y-shaped resilient latch portions can be generally disposed in a horizontal plane and have first and second capture members extending from distal ends thereof. The first and second capture members can be configured to extend into respective first and second engagement sections for securing the structural rib or connector of the umbrella to the hub. The first and second capture members can be configured to deflect in the horizontal plane.

Further, the capture members can define a vertical contact surface for contacting a portion of the structural rib or connector of the umbrella. The contact surface can be configured to allow the portion of the structural rib or connector to cause deflection of the capture members to thereby allow the portion of the structural rib or connector to be at least partially received within the engagement sections of the hub. The capture members can further define an interior engagement surface disposed adjacent to the vertical contact surface. The engagement surface can be configured to retain the structural rib or connector in connection with the hub.

The hub can also be configured to comprise a retention mechanism disposed within the engagement section. The retention mechanism can comprise an elongate channel having a first portion and a second portion. The first portion can be located between the second portion and the outer periphery of the upper and lower hub sections. Further, the first portion can be smaller than the second portion. For example, the first portion of the channel can be narrower than the second portion thereof.

Additionally, the hub can comprise a retention mechanism disposed within each of the engagement sections wherein the retention mechanism comprises an elongate horizontal channel. In such an embodiment, the capture member can be disposed within the channel for contacting a portion of the structural rib or connector to the hub when the portion of the structural rib or connector is received into the channel.

In accordance with yet another embodiment, an umbrella hub assembly is provided that can comprise an umbrella hub and a rib. The hub can comprise a central portion, a body, and an elongate channel. The central portion can be configured to receive to an umbrella pole. The body can extend between the central portion and an outer periphery of the hub. The body can comprise an engagement section adjacent to the outer periphery. The engagement section can be configured to receive an end portion of an umbrella structural member. The elongate channel can be disposed within the engagement section and can comprise a first portion and a second portion. The first portion can be located between the second portion and the outer periphery of the body. The first portion can have a first width and the second portion can have a second width. The first and second widths can be measured in a generally vertical plane. In this regard, the first width can be generally less than a second width.

The rib can comprise an elongate structural member and an engagement member extending from a side surface thereof. In such an embodiment, the engagement member can comprise a first dimension that is less than the width of the first portion of the elongate channel and a second dimension that is greater than the width of the first portion of the elongate channel.

Further, it is contemplated that the engagement member can be oriented relative to the rib such that the second dimension is transverse to the longitudinal axis of the elongate structural member. In addition, the hub can further comprise a capture member disposed within the channel of the hub. The hub can also further comprise an upper hub section defining a portion of the engagement section and a lower hub section defining a portion of the engagement section. In such an embodiment, the capture member can be disposed between the upper and lower hub sections.

In accordance with yet other embodiments, the inventions disclosed herein can also comprise one or more umbrellas comprising any of the hubs.

In accordance with yet another embodiment, an umbrella hub assembly is provided that comprises an umbrella hub and a plurality of ribs. The umbrella hub can have an outer periphery and a plurality of engagement sections spaced about the outer periphery thereof. The engagement sections can each comprise an elongate channel disposed within the engagement section. The plurality of ribs can each comprise an engagement member configured to be at least partially and removably received within an engagement section of the umbrella hub. In this regard, upon being received in a respective engagement section, each engagement member can be rotated relative to the engagement section to thereby fix the rib relative to the engagement section such that the rib is permitted rotational movement relative to the engagement section.

Additionally, each engagement member can be received into a respective engagement section after passing through an elongate channel of the engagement section. Further, the elongate channel can comprise a first portion and a second portion. The first portion can be located between the second portion and the outer periphery of the hub. The first portion can have a first width and the second portion can have a second width. In an embodiment, the first width can be less than the second width. Furthermore, the first and second widths can be measured in a generally vertical plane. The engagement member can comprise a first dimension that is less than the first width of the first portion of the elongate channel and a second dimension that is greater than the first width of the first portion of the elongate channel. In such an embodiment, the engagement member can protrude from a side surface of the rib.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION

In accordance with an embodiment of the present inventions, there are provided various configurations of a hub and hub assembly that can be used with an umbrella support structure, such as an umbrella or pavilion, to facilitate the rapid and secure fastening of structural ribs with a hub or other rib of the structure. As described in greater detail herein, the hub and hub assembly can incorporate various features such that a secure connection with a structure, such as a mounting member of a hub of an umbrella, can be obtained. Additional details and features of related umbrella rib connectors and assemblies are illustrated and described in Applicant's co-pending U.S. patent application Ser. No. 11/849,222, filed on Aug. 31, 2007, entitled QUICK CONNECTOR FOR SHADE STRUCTURE, the entirety of the contents of which are incorporated herein by reference.

In some embodiments, the hub can be uniquely configured in a manner that reduces the cost for manufacture and assembly. For example, the hub can be made of as few as two parts, such as two halves of the hub that interconnect and attach to each other by the use of fastening means, such as screws, bolts, adhesives, or interlocking or pressure-fit elements on either of the parts of the hub. Further, the hub can be configured to include additional parts other than two halves. Such additional parts may serve to increase the functionality or otherwise enhance the physical characteristics of the hub. For example, the hub can include locking devices that facilitate the secure interconnection of the hub with a given umbrella rib. Exemplary embodiments of the same are provided herein to illustrate some of these principles.

The hub assembly can comprise a hub and an end of an umbrella rib. The hub of the assembly can be configured in any of the ways or combinations of the ways described herein to ensure that the umbrella rib is quickly and securely attached thereto while permitting relative rotational movement of the rib. Accordingly, the rib can be configured to include an interconnective geometry on a distal end thereof such that the distal end of the rib can be interconnected with the hub. The interconnection may allow for selective disengagement of the connection or may result in permanent connectivity.

Figure 1:
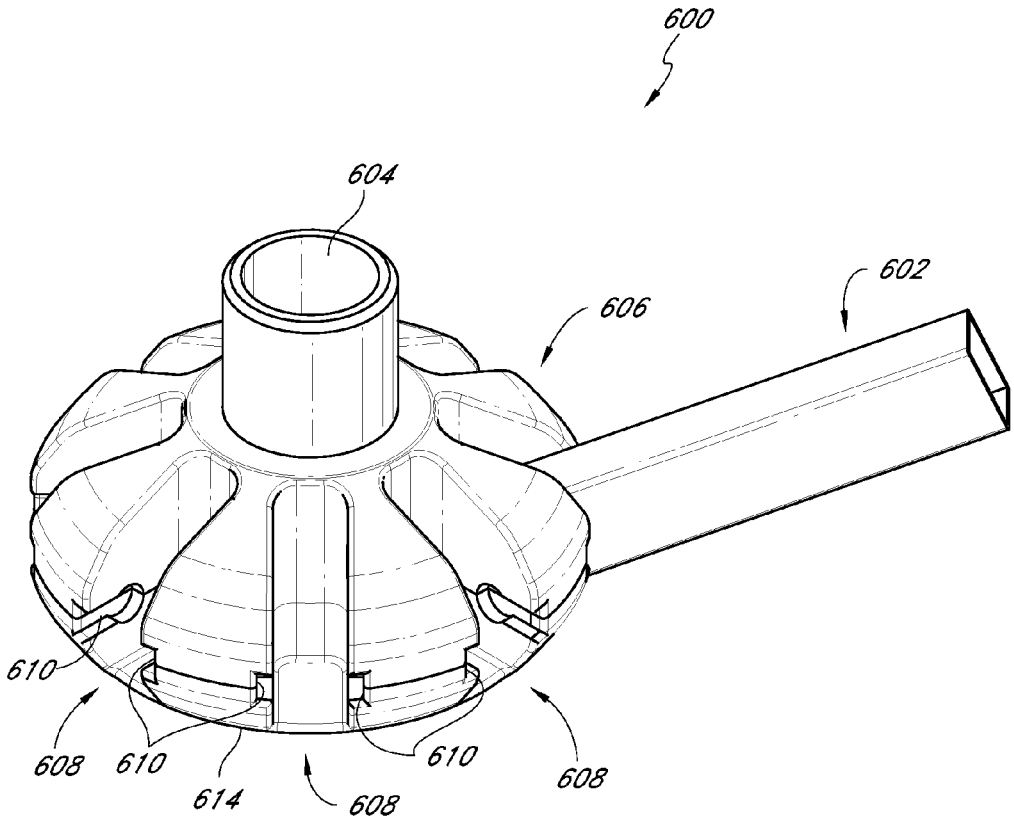
FIG. 1 is a perspective view of a hub assembly and umbrella rib, according to one embodiment.

Referring now to the drawings wherein the showings are made for purposes of illustrating preferred embodiments of the present inventions and not for purposes of limiting the same, FIG. 1 is a perspective view of an embodiment of a hub 600 and umbrella rib or connector 602. The hub 600 can be interconnected with a plurality of ribs 602, as described herein. The hub 600 and rib 602 can be referred to as a hub assembly or system. It is contemplated that various configurations of the rib 602 can be used. The rib 602 can be part of an umbrella canopy support structure, and the support structure can also have any of a variety of configurations. Accordingly, it is contemplated that the hub 600 and a corresponding plurality of ribs 602 can be used as components of an umbrella assembly. As described herein, the hub 600 can provide favorable advantages and attributes that can enhance the quality and stability of an umbrella structure.

In addition, when used with an umbrella assembly, the principles and features of the hub 600 can be used in an upper hub or lower hub of an umbrella assembly. Various modifications to the hub 600 can be made in order to suit the hub 600 for either application, such as providing for means to fix the hub 600 to an umbrella pole or to allow the hub 600 to be slidably coupled thereto. Furthermore, as described and shown herein, the hub 600 and its components are described and shown in terms of being a lower hub of an umbrella assembly. Therefore, the descriptions should not be deemed as limiting the hub 600 for only lower hubs, but can equally be applied to upper hubs.

Figure 3:
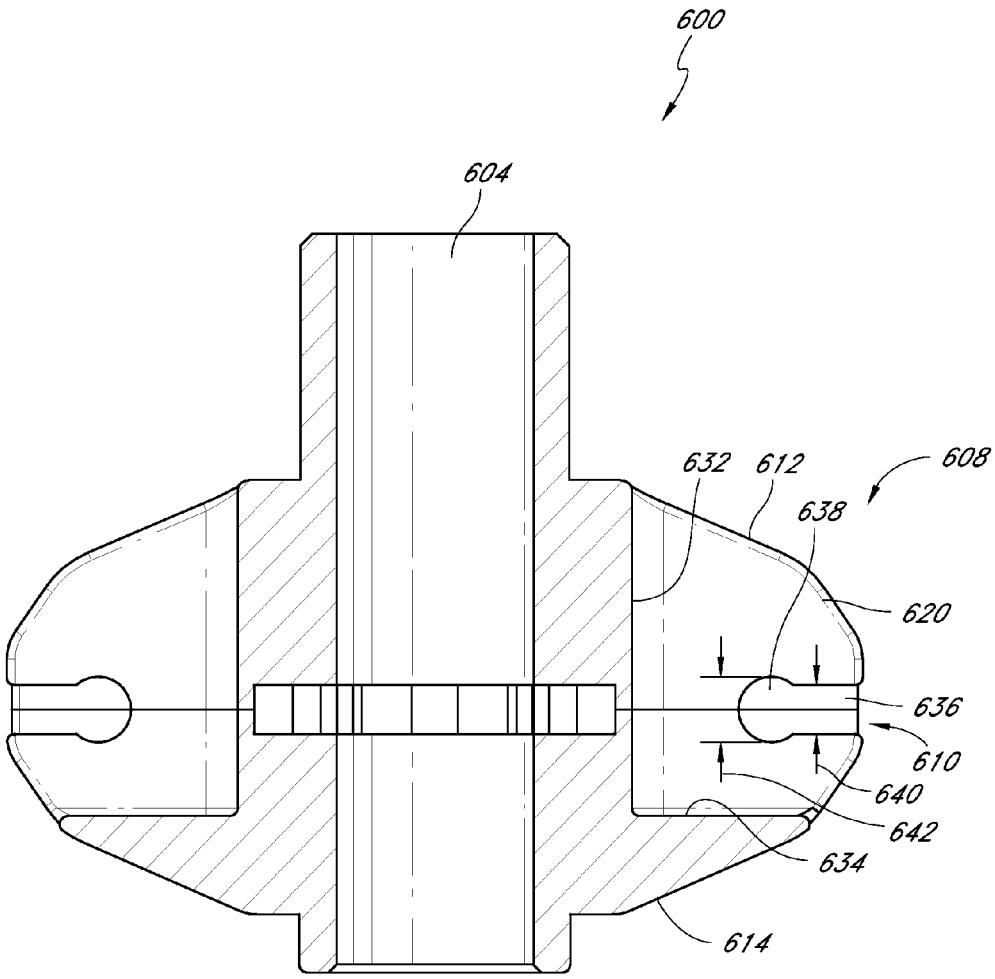
FIG. 3 is a side cross-sectional view of the hub assembly of FIG. 2 taken along lines 3-3, illustrating a configuration of an engagement section and retention mechanism, according to an embodiment.

FIG. 1 illustrates that the hub 600 can comprise a central portion 604, a body 606, an engagement section 608, and a retention mechanism 610. In some embodiments, the body 606 of the hub 600 can comprise one or more portions, such as an upper hub section 612 and a lower hub section 614, as also illustrated in the side cross-sectional view of FIGS. 3 and 6. Nevertheless, it is contemplated that the hub 600 can be fabricated from more or less parts. Furthermore, it is contemplated that the hub 600 can be fabricated from one or more materials in order to take advantage of certain material properties while taking into account other considerations, such as cost, manufacturability, weight, functional considerations, and other considerations.

In embodiments where the hub 600 comprises upper and lower hub sections 612, 614, the upper and lower hub sections 612, 614 can be attached to each other using any of a variety of mechanical fasteners, joining agents or processes. For example, screws can be used to couple the upper and lower hub sections 612, 614. Further, the upper and lower hub sections 612, 614 can be formed to provide a snap or interference fit. Additionally, an adhesive or other material can be used to join the upper and lower hub sections 612, 614.

Figure 2:
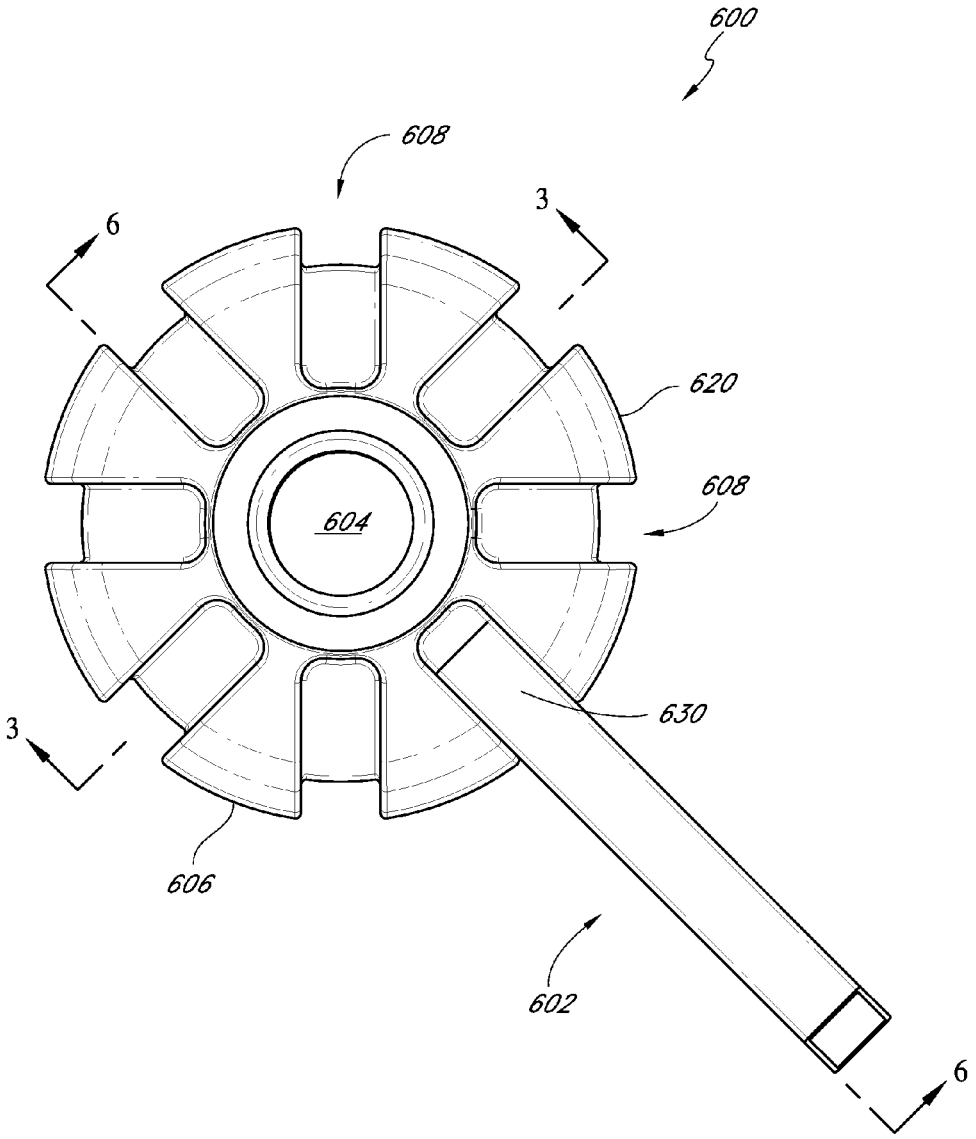
FIG. 2 is a top plan view of the hub assembly and rib of FIG. 1.

As illustrated in FIGS. 1 and 2, the central portion 604 of the hub 600 can be configured to be coupled to an umbrella pole. For example, as illustrated, the central portion 604 can be configured as a centrally-disposed cylindrical aperture that is configured to receive an umbrella pole therein. In some embodiments, the hub 600 can be configured to be slidably and/or rotationally coupled to the umbrella pole, while in other embodiments, the hub 600 may be fixedly coupled to the umbrella pole so as to resist longitudinal movement along the umbrella pole. In such embodiments, hub 600 may be configured to provide rotation of the hub 600 relative to the umbrella pole while resisting longitudinal movement.

The engagement sections 608 of the hub 600 can be spaced about the body 606 of the hub 600. In the illustrated embodiment, the engagement sections 608 are symmetrically spaced about an outer periphery 620 of the hub 600. In other embodiments of the hub 600, the engagement sections 608 can be spaced asymmetrically and/or in any variety of configurations.

The engagement sections 608 are configured to receive an end portion 630 of the rib 602, as illustrated in FIGS. 1 and 2. As shown in the side cross-sectional view of FIG. 3, the engagement sections 608 can be configured with a lateral boundary 632 and a horizontal boundary 634. The lateral and horizontal boundaries 632, 634 of the engagement section 608 can define a maximum pivoting angle for the rib 602 relative to the hub 600. The lateral boundary 632 is shown as being generally vertical, thus allowing the rib 602 to be pivoted upwardly until becoming oriented generally parallel relative to an axis of the central portion 604 or the umbrella pole. As described below, in some embodiments, this maximum angle or orientation of the rib 602 relative to the hub 600 can allow a user to interconnect or disconnect the rib 602 to or from the engagement section 608 of the hub 600. Further, the horizontal boundary 634 can define an upper travel limit for the hub 600 or rib relative to the pole, which is reached when the rib 602 pivots downwardly until contacting the horizontal boundary 634. Alternatively, when the hub is used as an upper hub in an umbrella assembly, the horizontal boundary 634 can define a travel limit of the rib coupled to the engagement section. Thus, the motion of the rib can be restricted by the horizontal boundary 634 whether the hub is used as an upper or lower hub in an umbrella assembly.

In accordance with at least one embodiment, the engagement sections 608 can be configured to include the retention mechanism 610. The retention mechanism 610 can comprise an elongate channel extending from the outer periphery 620 of the hub 600 toward the central portion 604 thereof. The channel can be generally linear and extend from an open end toward a closed end. For example, the channel can be straight. The illustrated embodiment is one in which the channel is of a constant width. However, other embodiments can be configured such that the channel tapers (e.g. to a smaller width) towards the closed end. In other embodiments, the channel can include notches, a step-wise narrowing structure, and/or numerous other configurations.

The channel can define first and second portions 636, 638. As illustrated, the first portion 636 can be located between the second portion 638 and the outer periphery 620 of the body 606. As discussed herein, the first and second portions 636, 638 can be configured to facilitate interconnection of the rib 602 with the retention mechanism 610. For example, the first portion 636 of the channel can define a first width 640 that is less than a second width 642 of the second portion 638. In the illustrated embodiment, the first and second widths 640, 642 are measured in a generally vertical plane. Further, the first and second widths 640, 642 can generally represent a vertical dimension of the respective ones of the first and second portions 636, 638 of the channel of the retention mechanism 610. As illustrated, the first portion 636 can also define a generally constant width, and the second portion 638 can define a variable width. In some embodiments, the second portion 638 can have a generally circular side profile, as shown.

In the illustrated embodiment, in order to facilitate engagement of the rib 602 with the hub 600, the rib 602 can include an engagement member 650 extending outwardly from the rib 602 that is configured to be received into the retention mechanism 610. In this manner, the engagement member 650 can be received into the first portion 636 of the channel. As discussed below, the engagement member 650 can be captured within the close perimeter of the second portion 638 of the channel when the rib or connector 602 is rotated relative to the engagement section 608 of the hub 600. Thus, a device can be provided for securing the rib or connector 602 to a structure that relies primarily on the geometries of the engagement member 650 and the configuration of the retention mechanism 610.

Figure 4:
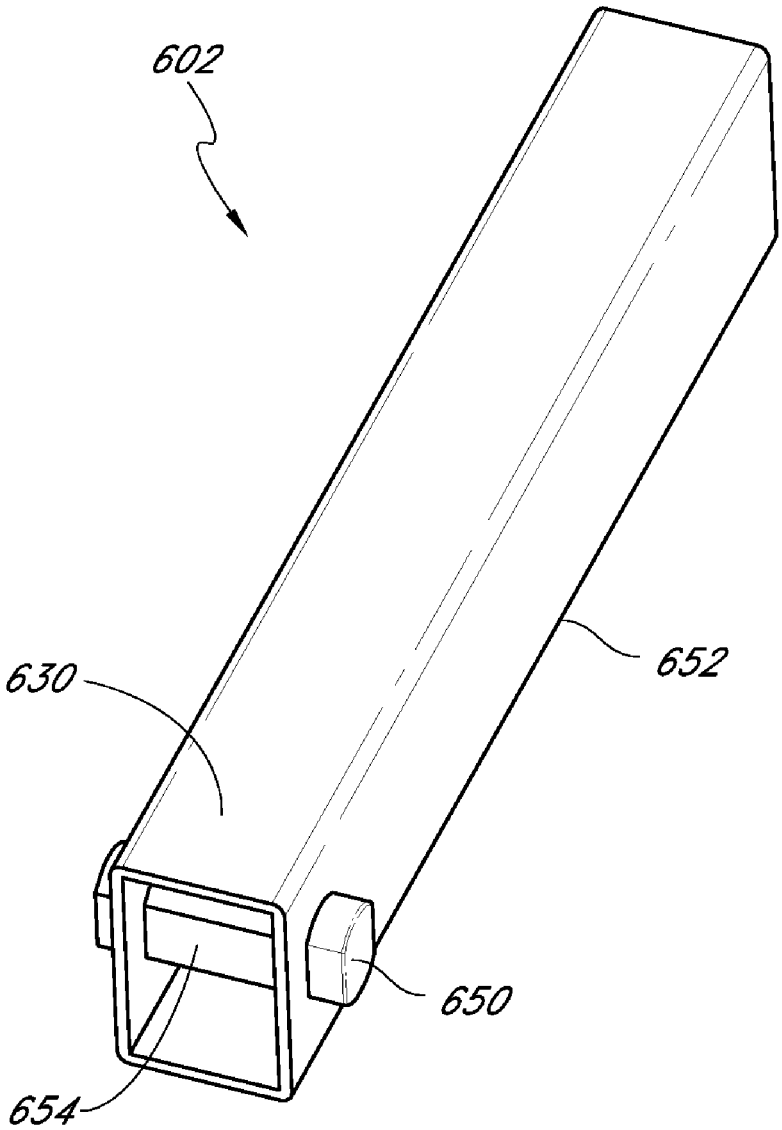
FIG. 4 is a perspective view of the rib of FIG. 1, further illustrating an engagement member extending from a side surface of a structural member of the rib, according to an embodiment.
Figure 5A:
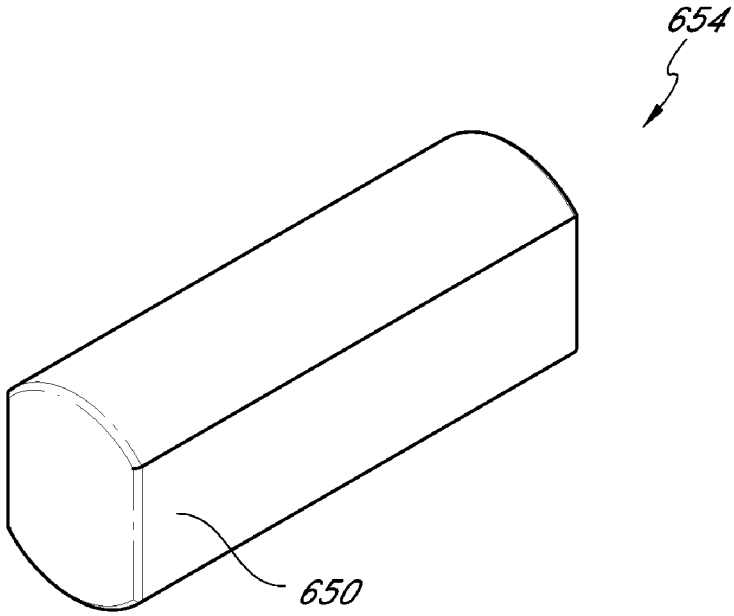
FIG. 5A is a perspective view of the engagement member shown in FIG. 4.

In the embodiment shown in FIG. 4, the rib 602 can include an engagement member 650 extending outwardly from the rib 602 at the end portion 630 thereof. In some embodiments, a pair of engagement members 650 can protrude from side surfaces of the end portion 630 of the rib 602. The engagement members 650 can be integrally formed with the rib 602, such that the engagement members 650 and the rib 602 are formed from a continuous piece of material. However, it is also contemplated that the rib or connector 602 can comprise a hollow body 652 and a locking pin 654 that can be coupled to the hollow body 652, as shown in FIGS. 4-5A. In such an embodiment, the locking pin 654 can be configured such that the engagement member 650 extends therefrom when coupled with the body 652 of the rib 602. The locking pin 654 can be coupled or attached to the body 652 using mechanical means, such as fastener, a press or interference fit, or by joining means, such as a bonding agent or process.

The engagement members 650 of the locking pin 654 can be configured to define a plurality of cross-sectional dimensions to facilitate engagement of the rib 602 with the retention mechanism 610 of the hub 600. In some embodiments such as the illustrated embodiment of FIGS. 5A-B, the locking pin 654 defines the same cross-sectional configuration as the engagement member 650, although the locking pin 654 be otherwise configured to facilitate interconnection with the rib 602. Further, when a pair of engagement members 650 is used with the rib 602, it is contemplated that one or both of the engagement members 650 can define a plurality of cross-sectional dimensions, as illustrated in FIG. 5A. However, it is also contemplated that one of the pair of engagement members 650 can be dimensioned differently from the other.

Figure 5B:
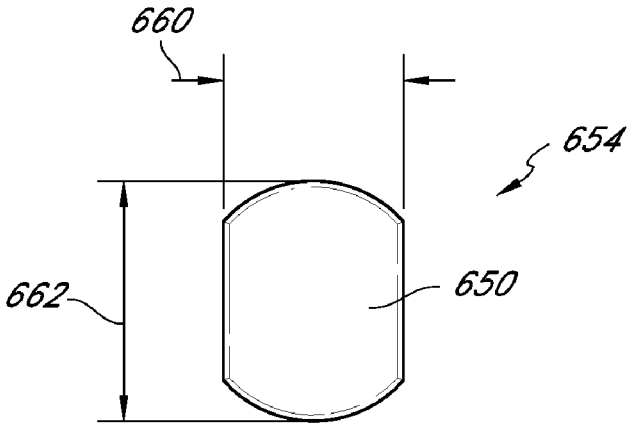
FIG. 5B is a side view of the engagement member shown in FIG. 5A.

In some embodiments, the engagement member 650 defines a generally polygonal cross-section, such as a rectangular or other elongate cross-section. In some embodiments, the engagement member 650 can be oblong, e.g., having a first dimension that is greater than a second dimension transverse to the first dimension. For example, the engagement member 650 can have a cross-section that is rectangular with rounded edges, such as a rounded rectangle. Thus, the engagement member 650 can define a cross-sectional first width 660 and a cross-sectional second width 662, as shown in FIG. 5B. However, the engagement member 650 can also be generally circular in its cross-section or otherwise shaped.

Further, in yet other embodiments, the engagement member 650 can have a cross-section that is circular with a secant or chord of the circle defining a flat side thereof wherein a radius of the circle is greater than the distance from a midpoint of the chord and a point on the circle disposed along a line perpendicular with the midpoint. In yet other embodiments, the engagement member 650 can have a cross-section that is a rectangle whose top and bottom lengths are capped off with semicircles of a diameter equal to the width of the rectangle, e.g., an oval or stadium, as shown in FIGS. 5A-B. Finally, in yet other embodiments, the engagement member 650 can have a cross-section defining various other detailed shapes.

Figure 6:
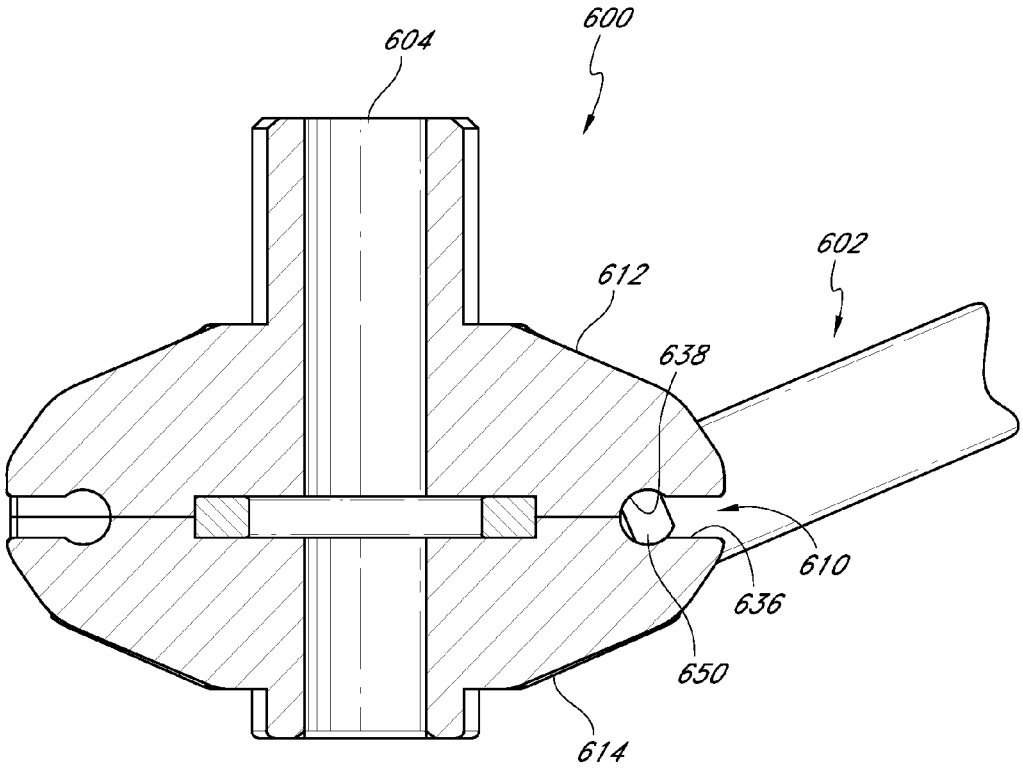
FIG. 6 is a side cross-sectional view of the hub assembly and rib of FIG. 2 taken along the lines 6-6, illustrating engagement between the engagement member of the rib and the retention mechanism of the hub.

Referring now to FIG. 6, the engagement of the retention mechanism 610 of the hub 600 and the engagement member 650 is illustrated. As mentioned above, in an embodiment, the cross-sectional first width 660 of the engagement member 650 can be greater than the width 640 of the first portion 636 of the channel and the cross-sectional second width 662 can be less than the width 640 of the first portion 636 of the channel. Therefore, in order to insert the engagement member 650 into the first portion 636 of the channel, the engagement member 650 can be longitudinally inserted into the open end of the first portion 636 of the channel, such that the cross-sectional width 660 can be received within the width 640 of the first portion 636.

Once the engagement member 650 passes through the open end of the first portion 636 of the channel and reaches the closed end or second portion 638 of the channel, the engagement member 650 can be freely rotated within the generally closed perimeter of the second portion 638. In such an embodiment, because the width 642 of the closed perimeter of the second portion 638 is greater than the cross-sectional first width 660 of the engagement member 650, the engagement member 650 can be freely rotated relative to the closed perimeter of the second portion 638. Further, when the engagement member 650 is not longitudinally disposed relative to the first portion 636 or narrower portion of the channel, the engagement member 650 will be captured within the closed perimeter of the second portion 638 because the cross-sectional second width 662 of the engagement member 650 is greater than the width 640 of the first portion 636 of the channel. In this regard, the engagement member 650 cannot be extracted from the second portion 638 of the channel unless and until it is appropriately generally aligned with the first portion 636 of the channel.

In an embodiment, the orientation of the rib or connector 602 relative to a support structure (illustrated herein as the hub 600) when assembled and when in an expanded or set-up state, is such that the first width 660 of the engagement member 650 is not aligned with the narrowed section of the first portion 636 of the channel. When the first width 660 of the engagement member 650 and the narrowed section of the first portion 636 are misaligned, their respective geometries prevent the rib or connector 602 and hub 600 (or analogous structure) from being inadvertently disconnected.

Referring again to FIG. 4, the umbrella rib 602 can be configured to have a generally rectangular cross section. However, other configurations of the rib 602, such as cylindrical or otherwise, are contemplated. As mentioned above, the rib 602 can comprise an entire umbrella support rib or can comprise only a section thereof. For example, the rib 602 can be a connector that attaches to a distal end of an umbrella rib. Thus, the rib 602 and hub 600 could be integrated with an existing umbrella support structure as retrofit parts.

Figure 7:
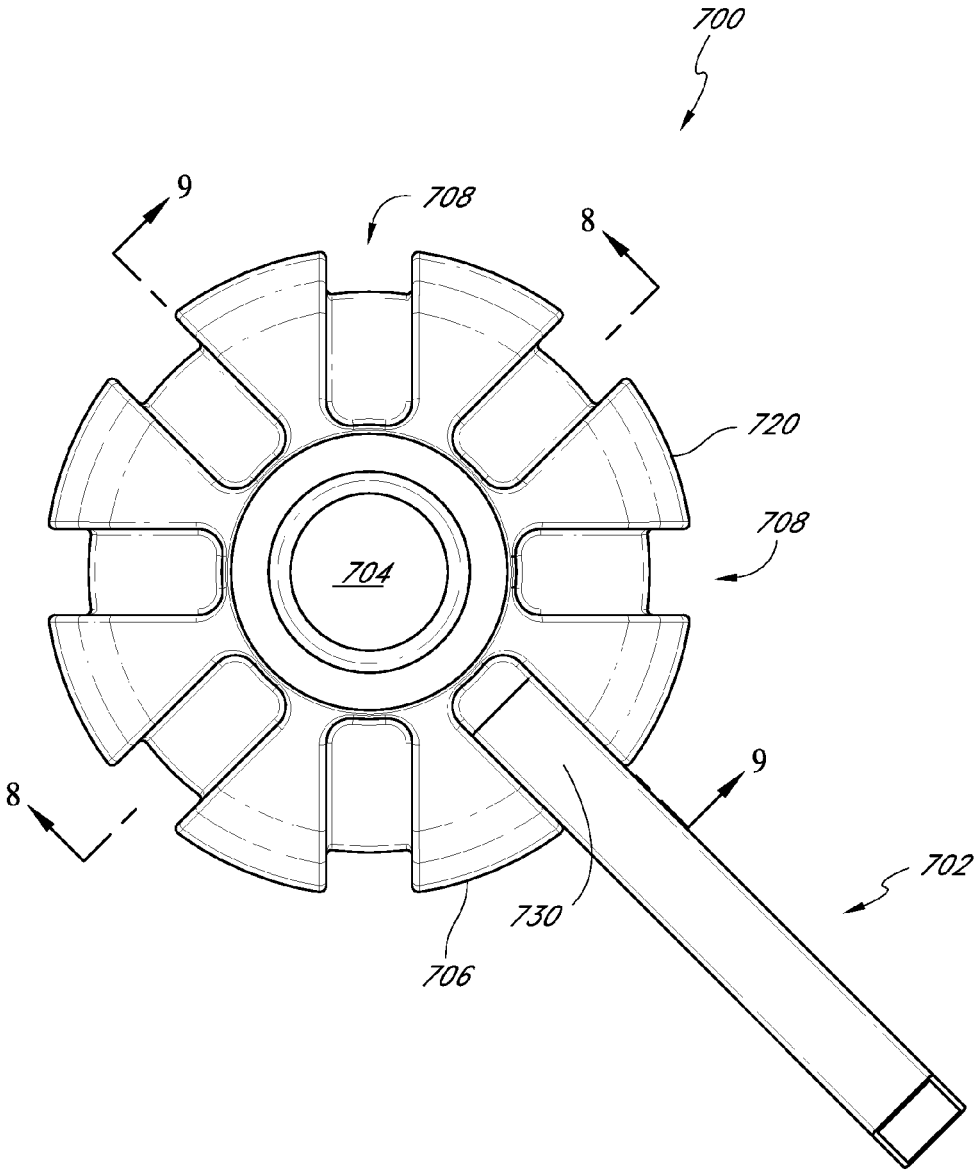
FIG. 7 is a top plan view of a hub assembly and umbrella rib, according to another embodiment.
Figure 8A:
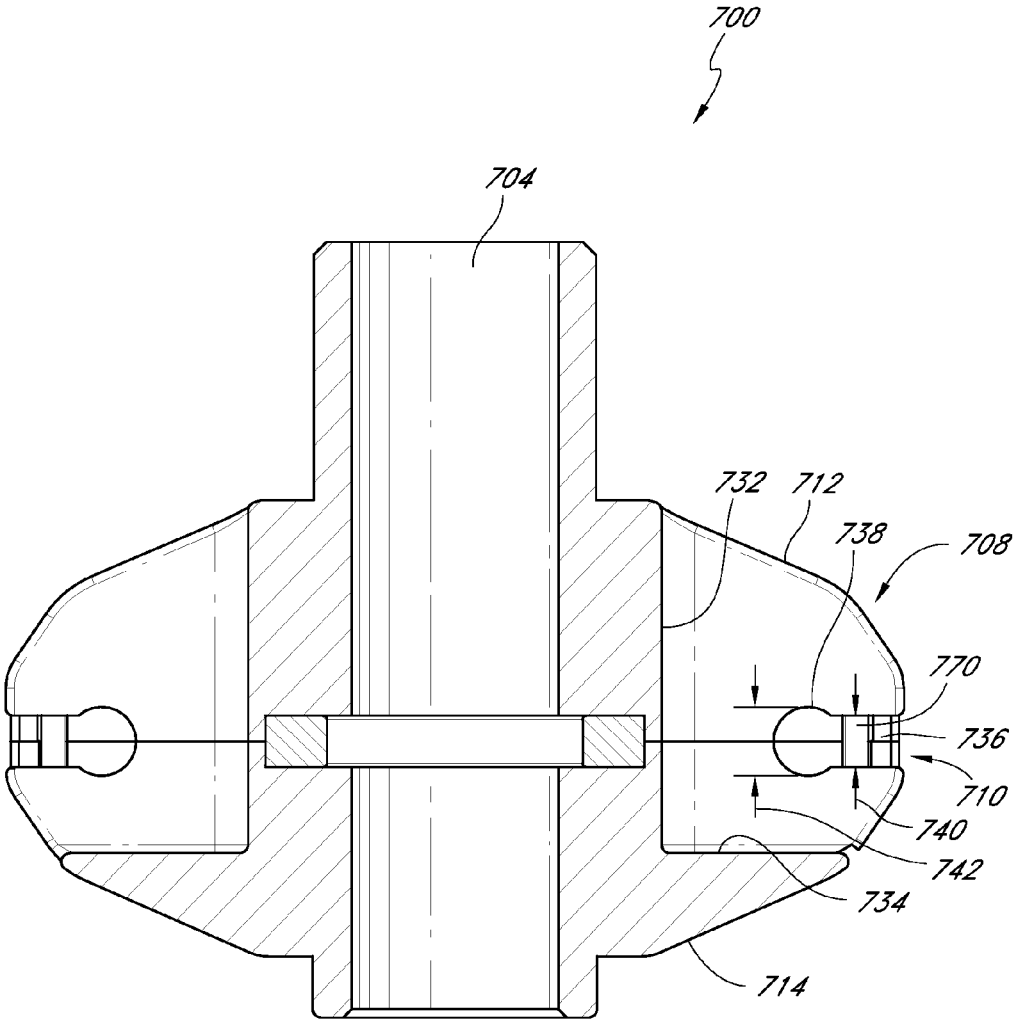
FIG. 8A is a side cross-sectional view of the hub assembly of FIG. 7 taken along lines 8A-8A, illustrating an engagement section, a retention mechanism, and a capture member disposed within a channel of the retention mechanism, according to an embodiment.
Figure 9:
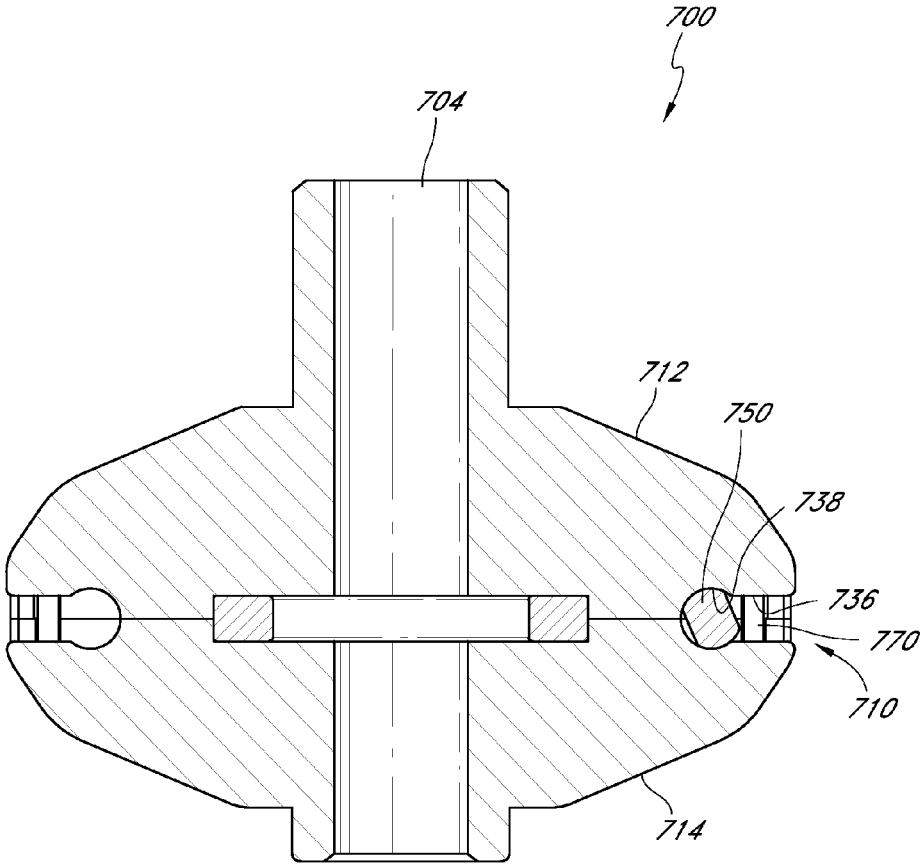
FIG. 9 is a side-cross sectional view of the hub assembly and rib of FIG. 7 taken along lines 9-9, illustrating engagement between the retention mechanism, the capture member, and an engagement member of rib.

FIG. 7 is a top plan view of another embodiment of a hub 700 and umbrella rib or structural member 702, collectively referred to as a hub assembly. FIGS. 8A and 9 are side cross-sectional views of the hub 700 taken along lines 8A-8A and 9-9, respectively, of FIG. 7. As noted above with respect to the embodiment of the hub 600, the hub 700 can also comprise a central portion 704, a hub body 706, an engagement section 708, and a retention mechanism 710. In addition, the hub 700 can comprise upper and lower hub sections 712, 714, respectively. The hub 700 can also define an outer periphery 720 and the rib 702 can define an end portion 730. The engagement section 708 can define lateral and horizontal boundaries 732, 734. The retention mechanism 710 can comprise a channel with first and second portions 736, 738, with the first portion 736 defining a width 740, and the second portion defining a width 742. Finally, the rib can comprise an engagement member 750, and may also be comprised of a hollow body and a locking pin 754. All of these elements of the hub 700 and rib 702 can share the same features and characteristics as noted above with respect to the hub 600 and rib 702. Therefore, the descriptions of these elements will not be repeated with respect to the hub 700 and the rib 702.

In addition, as noted above with respect to the hub 600, when used with an umbrella assembly, the principles and features of the hub 700 can be used in an upper hub or lower hub of an umbrella assembly. Various modifications to the hub 700 can be made in order to suit the hub 700 for either application, such as providing for means to fix the hub 700 to an umbrella pole or to allow the hub 700 to be slidably coupled thereto. Furthermore, as described and shown herein, the hub 700 and its components are described and shown in terms of being a lower hub of an umbrella assembly. Therefore, the descriptions should not be deemed as limiting the hub 700 for only lower hubs, but can equally be applied to upper hubs.

FIGS. 8A and 9 illustrate side cross-sectional views of the hub assembly of FIG. 7, wherein the hub 700 can further comprise a capture member 770 disposed within the channel of the retention mechanism 710. The capture member 770 can be disposed between the upper and lower hub sections 712, 714. In the illustrated embodiment, the capture member 770 can be a deflectable member that assists in retaining the engagement member 750 of the rib 702 captured within the second portion 738 of the channel. The capture member 770 can be incorporated with the hub 700 using a variety of configurations and parts. Such exemplary features are shown in greater detail in FIGS. 10-12C.

Figure 8B:
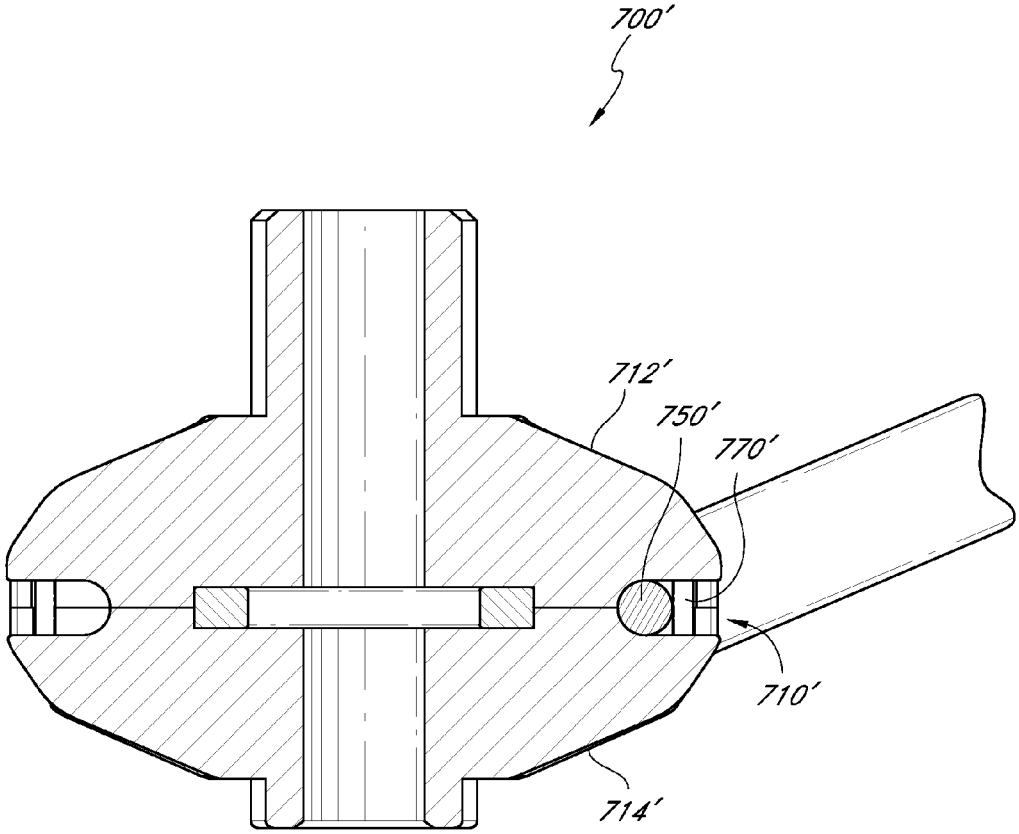
FIG. 8B is a side cross-sectional view of another embodiment of a hub assembly, illustrating an engagement section and a retention mechanism with a straight channel and a capture member disposed within the channel.

The retention mechanism of the hub 700, as shown in FIG. 8A, can comprise a uniquely-shaped channel of the retention mechanism 710 wherein the first and second portions 736, 738 of the channel are configured with different widths. Further, engagement and retention of an engagement member 750 with an asymmetric cross-sectional profile is described and shown in FIG. 9. However, in an embodiment illustrated in FIG. 8B, it is contemplated that a retention mechanism 710' can accomplish the engagement and retention of an engagement member 750' without a uniquely-shaped channel and instead may use only the capture member 770'. FIG. 8B is a side cross-sectional view of another embodiment of a hub 700' wherein the channel of the retention member 710' formed in upper and lower hub sections 712', 714' is straight and the capture member 770' is used to resist any radial force exerted on a rib to keep the engagement member 750' retained within the channel of the retention mechanism 710'.

Figure 10:
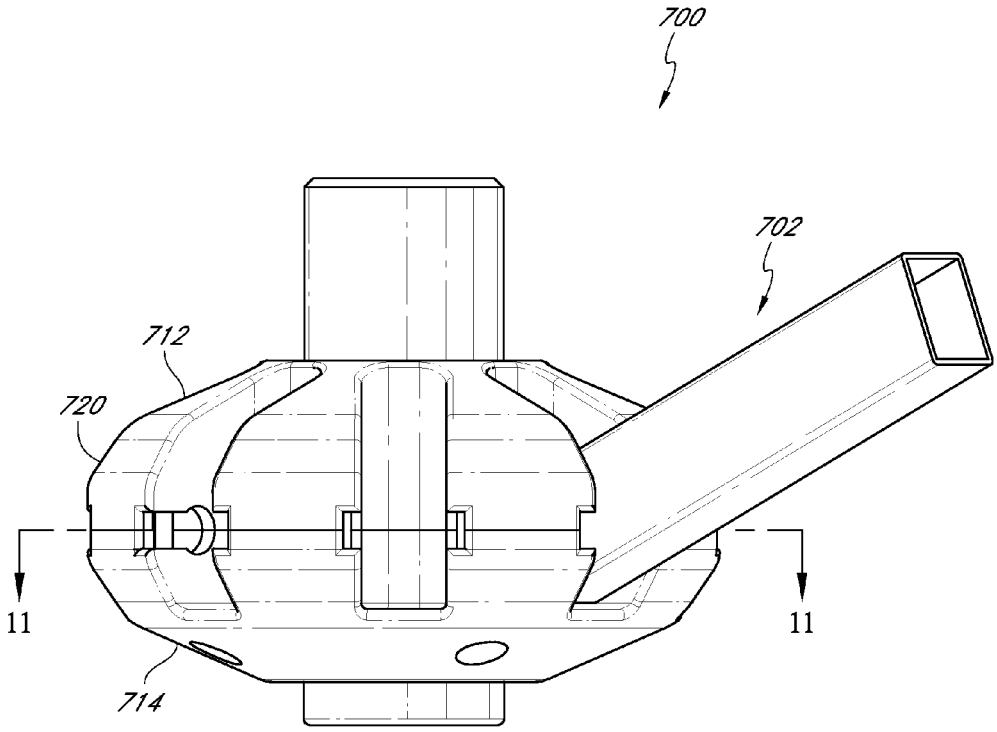
FIG. 10 is a side view of the hub assembly of FIG. 7, showing upper and lower hub sections and a locking component interposed between the upper and lower hub sections, according to an embodiment.
Figure 11:
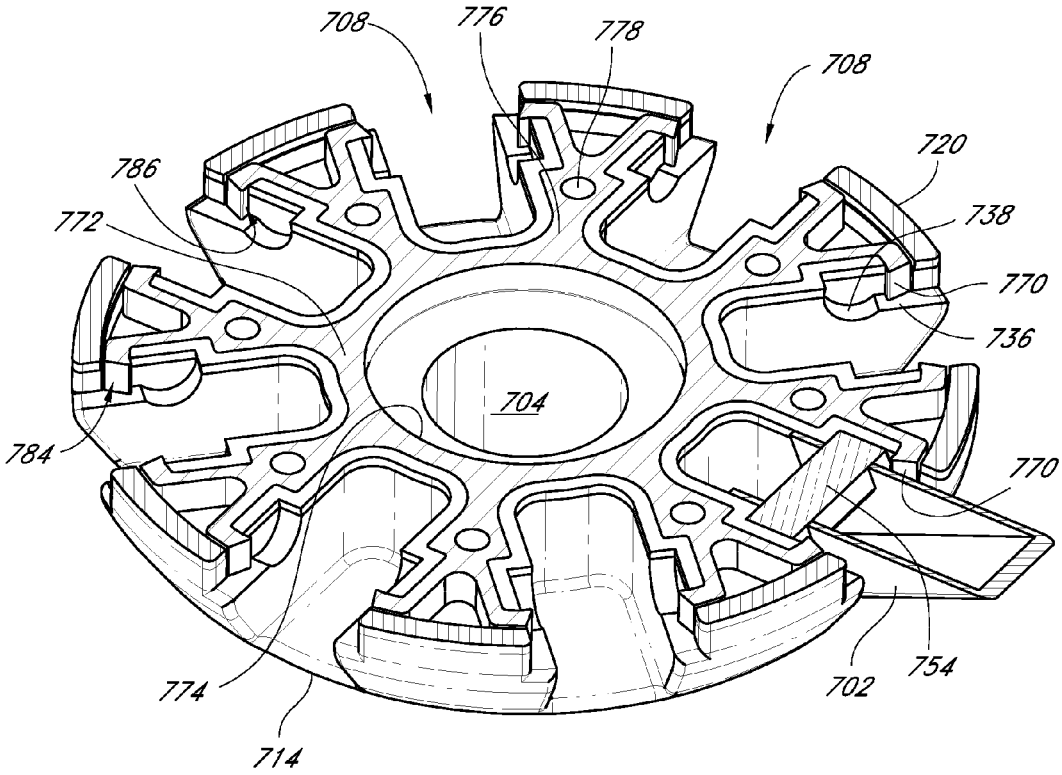
FIG. 11 is a perspective cross-sectional view of a locking component, the lower hub section, and the rib of the hub assembly of FIG. 10, illustrating the engagement of an engagement member of the rib with a capture member of the locking component, according to an embodiment.

Referring now to FIG. 10, a side view of the hub 700 of FIG. 7 is shown. The top perspective view of FIG. 11 illustrates that the hub 700 can comprise a locking component 772 that can be used to secure the rib 702 to the hub 700. The locking component 772 can be interconnected with the hub 700 and engage at least a portion of the end portion 730 of the rib 702. While in some embodiments it is contemplated that the locking component 772 can be integrally formed from the same material as the hub 700 or as one of the upper and lower hub sections 712, 714, the use of a separately-formed locking component 772 allows the locking component 772 to be manufactured from a material that is different from the material used for manufacturing the hub 700 or the upper and lower hub sections 712, 714. Accordingly, one may select a material with advantageous properties for the locking component 772 while using a different material for the upper and lower hub sections 712, 714. This design flexibility can ensure that the hub 700 provides desired structural properties while permitting potential cost savings.

The locking component 772 can be received between the upper and lower hub sections 712, 714. Thus, the locking component 772 can be configured to be disposed intermediate the upper and lower hub sections 712, 714 when the upper hub section 712 is connected with the lower hub section 714. For example, the locking component 772 can be centrally disposed between the upper and lower hub sections 712, 714 with a central portion 774 corresponding to the central portion 704 of the hub 700. In some embodiments, the central portion 774 can be oriented concentrically relative to the central portion 704 of the hub 700.

The locking component 772 can comprise a component body 776. In an embodiment, the movement of the body 776 of the locking component 772 can be generally inhibited relative to the upper and lower hub sections 712, 714. For example, the locking component 772 can define a unique geometry corresponding to a geometry of one or both of the upper and lower hub sections 712, 714. As shown in FIG. 11, an interior of the lower hub section 714 can be configured to mimic at least a portion of the geometry of the locking component 772 such that the locking component 772 is restricted in its rotational and/or translational movement. Further, the locking component 772 can comprise one or more motion limiting stop members 778. The stop members 778 can comprise structures that mate with corresponding structures internal to one or both of the upper and lower hub sections 712, 714. The stop members 778 can be apertures or protrusions on the locking component 772. Thus, by means of the stop members 778, the movement of the body 776 of the locking component 772 can be generally inhibited relative to the upper and lower hub sections 712, 714.

Figure 12A:
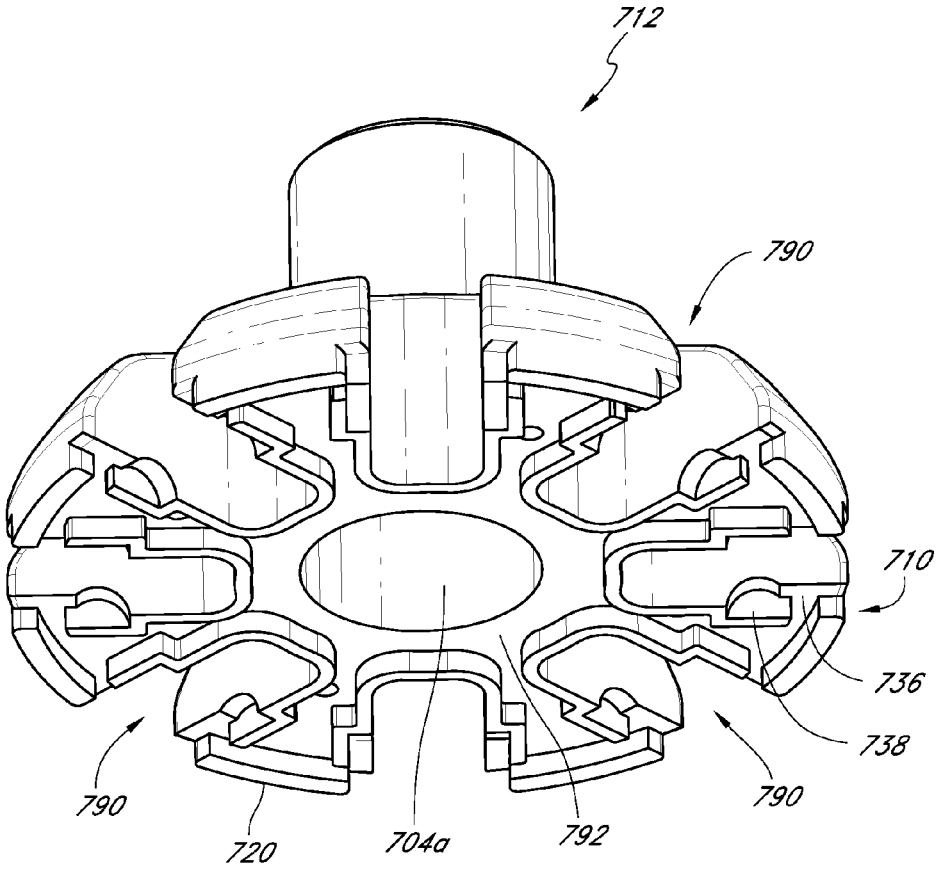
FIG. 12A is a perspective view of the upper hub section of the hub assembly shown in FIG. 10.
Figure 12B:
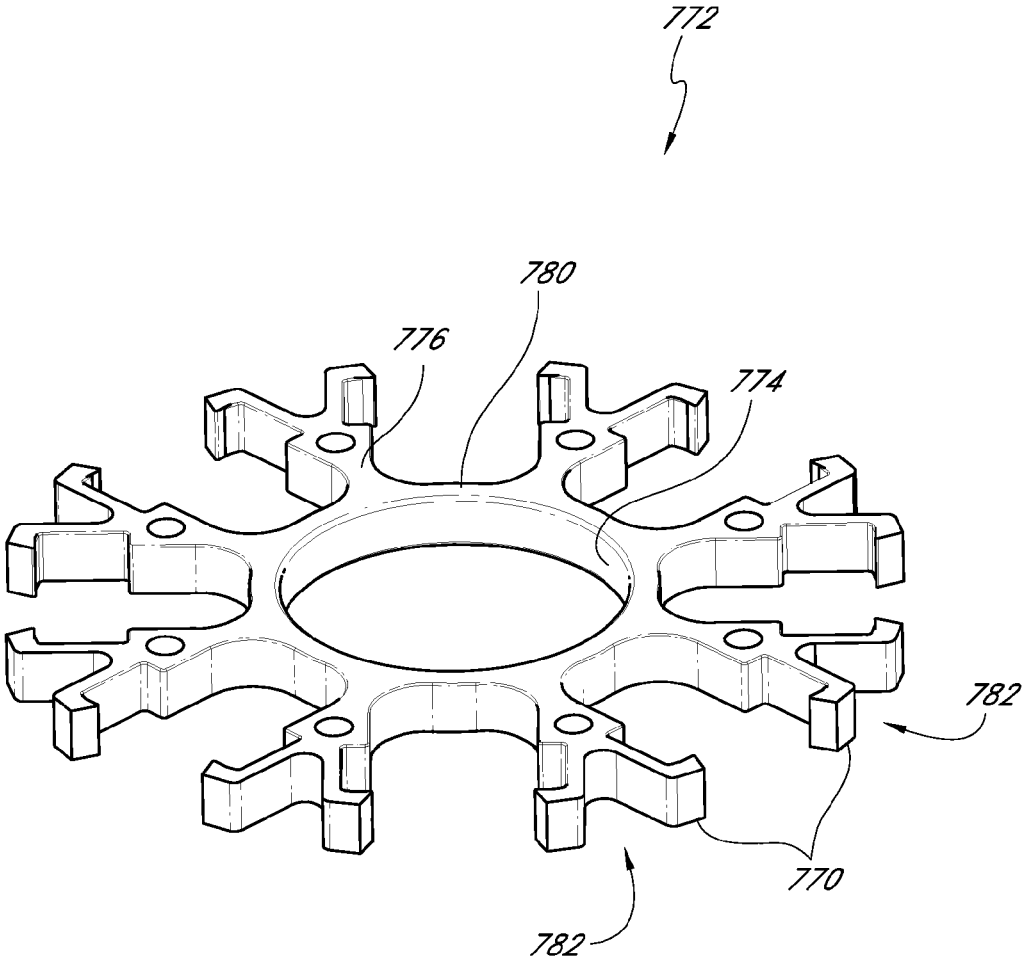
FIG. 12B is a perspective view of the locking component of the hub assembly shown in FIG. 10.

In the embodiment illustrated in FIGS. 11 and 12B, the locking component 772 can comprise a ring section 780 and a plurality of resilient latch portions 782 extending therefrom. Each of the latch portions 782 can comprise one or more of the capture members 770. As similarly mentioned above, the locking component 772 can be configured such that when the upper and lower hub sections 712, 714 are assembled, the capture member 770 can be disposed intermediate the upper and lower hub sections 712, 714 at protrude at least partially into an engagement section 708 of the hub 700. Further, the hub 700 can be configured such that respective capture members 770 can extend into each engagement section 708 from opposing side surfaces of the engagement section 708. When inserted into the engagement section 708, a rib 702 can be received and retained by the capture member 770. For example, the capture member 770 can deflect to allow the engagement member 750 of the rib 702 to pass through the channel of the retention mechanism 710 toward the second portion 738 of the channel in order to be captured therein.

In accordance with an embodiment, the capture members 770 can be configured to deflect in a horizontal direction. Furthermore, the resilient latch portions 782 of the locking component 772 can define a plurality of outwardly extending Y-shaped members. The Y-shaped members can be generally disposed in a horizontal plane and having first and second capture members 770 coupled thereto. In such an embodiment, the first and second capture members 770 can be configured to deflect in the horizontal plane. Thus, when the first and second capture members 770 are disposed within the channel of the retention member, the translational movement of the rib 702 in the horizontal plane can actuate or engage the capture members 770. In such an embodiment, when the hub 700 can facilitate alignment and retention of the rib 702 relative to the hub 700.

Furthermore, the embodiment illustrated in FIGS. 7-11 incorporates not only the geometric locking feature of the engagement member 750 with the channel of the retention member, but also incorporates the engagement of the capture member 770 with the engagement member 750. Thus, the rib 702 can be securely received within the engagement section 708 of the hub 700.

As illustrated in FIGS. 11 and 12B, the capture member 770 can comprise a ramped surface disposed in the channel of the retention mechanism 710. The capture member 770 can extend from a side surface of the engagement section 708 in a circumferential or inward direction. The ramped surface can be configured to engage a structural member, such as the engagement member 750, when the structural member is directed through the first portion 736 of the elongate channel toward the second portion 738 thereof. The capture member 770 can then respond to said engagement by moving from a first position in which the ramped surface protrudes a first amount into the engagement section 708 to a second position in which the ramped surface protrudes a lesser amount into the engagement section 708.

As such, the capture member 770 can permit passage of the structural member toward the second portion 738 of the channel. Once the structural member is no longer engaged by the capture member 770, the capture member 770 can return to the first position. The capture member 770 can further be configured such that one or more degrees of movement of the rib 702 is restricted when the structural member is received within the second portion 738 of the channel and the capture member 770 is in the first position. For example, the rib 702 may only be permitted to rotate relative to the hub 700 once the structural member is received within the second portion 738 of the channel and the capture member 770 is in the first position.

In addition, it is contemplated that the capture member 770 can define a vertical contact surface 784 for contacting a portion of the structural rib or connector. The contact surface can 784 be configured to allow the portion of the structural rib or connector to cause deflection of the capture member 770 to thereby allow the portion of the structural rib or connector to be at least partially received within the engagement section 708 of the hub 700. The capture member 770 can further define an interior engagement surface 786 disposed adjacent to the vertical contact surface 784, and the engagement surface 786 can be configured to retain the structural rib or connector in connection with the hub 700.

For example, in an embodiment, the engagement member 750 can abut the engagement surface 786 when the engagement member 750 is received into the second portion 738 of the channel. When a radial force is applied to the rib 702, which may otherwise cause the rib 702 to disengage with the hub 700, the engagement surface 786 of the capture member 770 can resist movement of the engagement member 750 out of the second portion 738 of the channel. Further, the radial force applied to the rib 702 can also be resisted by the channel of the retention mechanism 710 in embodiments wherein the first and second portions 736, 738 of the channel are configured with different widths and the engagement member 750 has an asymmetric cross-sectional profile.

FIGS. 12A-B illustrate embodiments of the upper and lower hub sections 712, 714. As discussed above, the hubs 600, 700 can be formed using upper and lower hub sections. In some embodiments, the hub can be formed using the upper and lower hub sections with a lower region of the upper hub section being connectable to an upper region of the lower hub section. In this regard, the upper and lower hub sections can be configured to cooperatively or individually form features of the hub, such as the engagement sections, the retention mechanisms, and other such structures. The upper and lower hub sections can be generally circularly-shaped; however, other configurations and geometries can be developed which incorporate the features discussed herein.

FIG. 12A is a bottom perspective view of the upper hub section 712, according to an embodiment. The upper hub section 712 can include a portion 704*a* of the central portion 704 of the hub 700. The upper hub section 712 can comprise a plurality of first slots 790 disposed about the outer periphery 720. Each of the slots 790 can be configured to define at least a portion of the engagement sections 708. For example, the slots 790 of the upper hub 712 can define portions of the first and second portions 736, 738 of the channel of the retention mechanism 710. Further, the upper hub section 712 can include a first recess 792 into which at least a portion of the locking component 772 can be received.

Figure 12C:
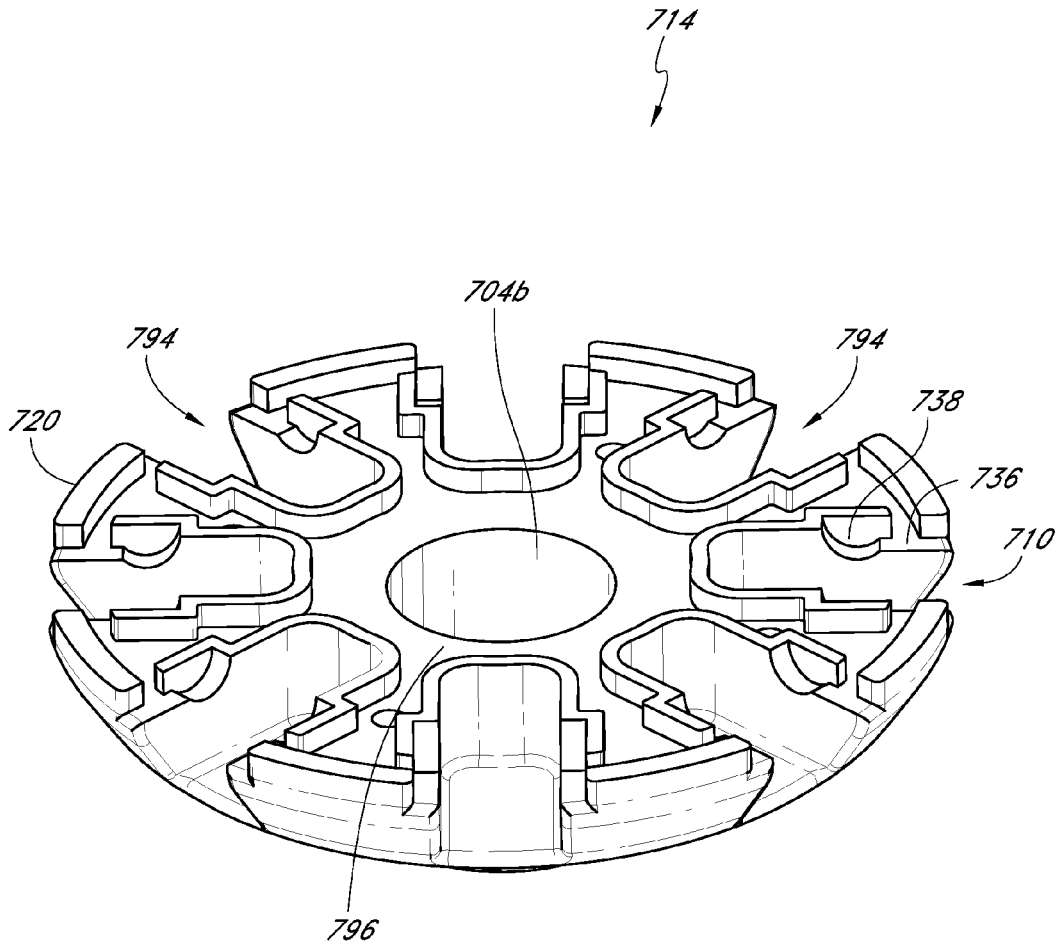
FIG. 12C is a perspective view of the lower hub section of the hub assembly shown in FIG. 10.

FIG. 12C similarly illustrates the lower hub section 714, according to an embodiment. The lower hub section 714 can include a portion 704*b* of the central portion 704 of the hub 700. Further, as with the upper hub section 712, the lower hub section 714 can comprise a plurality of second slots 794 disposed about the outer periphery 720. Each of the slots 794 can also be configured to define at least a portion of the engagement sections 708. For example, the slots 794 of the lower hub 714 can define portions of the first and second portions 736, 738 of the channel of the retention mechanism 710. Further, the lower hub section 714 can include a second recess 796 into which at least a portion of the locking component 772 can be received.

Nevertheless, it is contemplated that the upper and lower hub sections 712, 714 can be configured so as to eliminate or modify the respective ones of the first and second recesses 792, 796. For example, the second recess 796 of the lower hub section 714 can be configured receive the locking component 772 such that no corresponding recess is required in the upper hub section 712.

Furthermore, although the illustrated embodiment also shows that the retention mechanism 710 can be collectively formed by the upper and lower hub portions 712, 714, it is contemplated that in other embodiments, the retention mechanism 710 is formed by one of the upper and lower hub portions 712, 714. Accordingly, when used, some embodiments can be configured such that the first and second portions 736, 738 of the channel are formed into only one of the upper and lower hub sections 712, 714.

In accordance with yet other embodiments, the present inventions can also comprise one or more umbrellas comprising any of the hubs.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella hub comprising:

a central portion configured to be disposed about a longitudinal axis of an umbrella pole;

a body extending between the central portion and an outer periphery of the hub, the body comprising an engagement section adjacent to the outer periphery, the engagement section being configured to receive an end portion of an umbrella structural member; and a capture member extending into the engagement section, the capture member being configured to at least partially retract into the body within a plane oriented transverse relative to the longitudinal axis of the support pole to facilitate insertion of the umbrella structural member into the engagement section, the capture member being configured to engage with the end portion of the umbrella structural member when the end portion of the umbrella structural member is disposed in the engagement section.

2. The umbrella hub of claim 1, further comprising a locking component with a ring-like central portion and a plurality of capture members extending radially from the central portion, the locking component being configured to be interposed between upper and lower sections of the hub.

3. The umbrella hub of claim 1, wherein the hub further comprises an elongate channel extending along the engagement section, wherein the capture member extends at least partially into the elongate channel for engaging with the end portion of the umbrella structural member.

4. The umbrella hub of claim 3, wherein the elongate channel extends radially within the body.

5. The umbrella hub of claim 1, wherein the capture member comprises a ramped surface configured to contact the end portion of the umbrella structural member, wherein contact between the ramped surface and the end portion of the umbrella structural member causes deflection of the capture member from a first position to a second position.

6. The umbrella hub of claim 1, wherein the capture member moves along a generally arcuate path.

7. The hub of claim 1, wherein the capture member is configured to deflect between first and second positions in response to insertion of the umbrella structural member into the engagement section.

8. The hub of claim 7, wherein the capture member is configured to deflect in a plane oriented transverse relative to the longitudinal axis.

9. The hub of claim 1, wherein the hub comprises first and second capture members extending into the engagement section, the first and second capture members configured to deflect in generally opposite directions.

10. The hub of claim 1, wherein the capture member protrudes a first amount into the engagement section in a first position and protrudes a lesser amount into the engagement section in a second position.

11. The hub of claim 1, wherein the plane in which the capture member is configured to at least partially retract into the body is a generally horizontal plane.

12. An umbrella comprising:

an umbrella hub having an outer periphery and a plurality of engagement sections spaced about the outer periphery thereof, the engagement sections each comprising a capture mechanism being movable relative to the engagement section between first and second positions, the capture mechanism being permitted to move in a first plane that is oriented transverse relative to a longitudinal axis of an umbrella pole about which the umbrella hub is adapted to be mounted, the capture mechanism being constrained from movement in a second plane that is oriented transverse relative to the first plane, the capture mechanism comprising at least one capture member configured to move along a generally arcuate path; and a plurality of ribs each comprising an engagement member configured to be at least partially and removably received within an engagement section of the umbrella hub, the engagement member causing movement of the at least one capture member from the first position toward the second position during insertion of the engagement member into the engagement section, the engagement member being retained in the engagement section upon return of the capture mechanism toward the first position.

13. The umbrella of claim 12, wherein the umbrella hub is configured to permit movement of the capture mechanism generally in the first plane while constraining movement of the capture mechanism generally in the second plane.

14. The umbrella of claim 12, wherein the capture mechanism comprises a plurality of capture members, each capture member being configured to move along a generally arcuate path.

15. The umbrella of claim 12, wherein the capture mechanism comprises a ring-shaped locking component having a central portion and a plurality of capture members extending radially from the central portion.

16. The umbrella of claim 15, wherein the umbrella hub comprises an upper section and a lower section, at least one of the upper and lower sections comprising a recess, wherein when the upper section and the lower section are engaged, a cavity is formed between the recess and an opposite portion of the hub, the cavity configured to receive the locking component.

17. The umbrella of claim 12, wherein the engagement sections each comprise at least one elongate channel extending along a sidewall thereof, and wherein the at least one capture member extends at least partially into the elongate channel.

18. The umbrella of claim 12, wherein the at least one capture member comprises a ramped surface configured to contact the engagement member, wherein contact between the ramped surface and the engagement member causes movement of the capture member from a first position to a second position in the first plane.

19. An umbrella hub adapted to receive an umbrella pole, the hub comprising:

an outer periphery;

a body extending inward of the outer periphery, the body defining a plurality of engagement sections each being configured to receive an end portion of an umbrella structural member; and a plurality capture members disposed in the engagement sections, each of the capture members comprising a ramped surface being sloped toward the center of the engagement section;

wherein each capture member is adapted to respond to radial inward movement of the end portion of the umbrella structural member to cause the capture member to move between a first position in which the ramped surface protrudes a first amount into the engagement section and a second position in which the ramped surface protrudes a lesser amount into the engagement section; and wherein the capture member is adapted to respond to further radial inward movement of the structural member to move between the second and first positions.

20. The hub of claim 19, wherein the engagement sections of the body each comprise a channel extending radially inwardly of the outer periphery, each channel being configured to receive an end portion of an umbrella structural member.

21. The hub of claim 20, wherein the capture members are disposed in the channels of the engagement sections.

22. The hub of claim 19, wherein each capture member moves between the first and second positions in a first plane while being constrained from movement in a second plane.

23. The hub of claim 19, wherein the hub comprises a pair of capture members disposed in each engagement section.

24. The hub of claim 23, wherein each pair of capture members moves in a generally horizontal plane.

25. The hub of claim 19, wherein the capture member engages with a protrusion of the end portion of the structural member to block disengagement of the end portion from the engagement section.

26. The hub of claim 19, wherein the ramped surfaces of the capture members extend in generally vertical planes.

27. The hub of claim 19, further comprising a ring-shaped locking component having a central portion and a plurality of capture members extending radially from the central portion.

28. The hub of claim 19, wherein the capture members move along a generally arcuate path between the first and second positions.

* * * * *